United States Patent [19]

Galis

[11] 3,937,420

[45] Feb. 10, 1976

[54] LEVEL WIND DEVICE

[76] Inventor: Alex J. Galis, Heatherbrae Square, Apt. 101, Indiana, Pa. 15701

[22] Filed: Oct. 29, 1971

[21] Appl. No.: 193,642

[52] U.S. Cl. ..... 242/158.4 A
[51] Int. Cl.[2] ..... B65H 54/30
[58] Field of Search... 242/158.4 A, 158.4 R, 158.2, 242/43, 43.2

[56] References Cited

UNITED STATES PATENTS

| | | | |
|---|---|---|---|
| 1,472,847 | 11/1923 | McGann | 242/158.4 A |
| 1,918,587 | 7/1933 | Bryant | 242/158.4 A |
| 2,419,003 | 4/1947 | Bateman | 242/43 |
| 2,421,269 | 5/1947 | Joyce | 242/158.4 A |
| 2,437,725 | 3/1948 | Conner | 242/158.4 A |
| 2,757,883 | 8/1956 | Schlang et al. | 242/158.4 A |
| 2,964,261 | 12/1960 | Hambach et al. | 242/158.4 A |
| 3,061,237 | 10/1962 | Carter | 242/158.4 A |
| 3,266,741 | 8/1966 | Ferrier | 242/43.2 |

*Primary Examiner*—Stanley N. Gilreath
*Attorney, Agent, or Firm*—Stanley J. Price, Jr.

[57] ABSTRACT

The level wind apparatus includes a pair of parallel spooling shafts mounted in a frame and connected to each other for rotation in opposite directions. Both of the shafts have the same square thread profile with the same pitch and in the same direction. The shafts are positioned with the thread crest of one shaft in overlying relation with the thread root or spiral cam track of the other shaft. The spooling shafts are connected to each other for rotation at the same peripheral speed in opposite directions. In one embodiment opposing pin members are alternately positioned in the spiral cam tracks or threads of the respective shafts and control the direction of movement of a cable guide bracket that is suitably mounted on a horizontal shaft parallel to the pairs of threaded spooling shafts. The movement of one pin out of the thread or cam track and the movement of the other pin into the thread or cam track is controlled by the end thread in each of the shafts that is half pitch and has an inclined portion that tapers to zero depth. The tapered portion of the thread urges the pin out of the thread or cam track of one spooling shaft while the other pin is moved into the cam track of the other spooling shaft. Another embodiment includes a single pin member that is positioned in the thread or cam track of one spooling shaft and upon rotation moves to the end of that shaft where it is urged by the inclined end thread into the cam track of the other spooling shaft to move in the opposite direction. In another embodiment the strand or cable is positioned in the thread or cam track and moves transversely upon rotation of the shafts and the cable reverses the direction of transverse movement when it reaches the end of the shaft and is transferred into the cam track or thread of the other shaft.

2 Claims, 9 Drawing Figures

LEVEL WIND DEVICE

BACKGROUND OF THE INVENTION

1. Field of the Invention

This invention relates to a level wind apparatus for distributing a flexible strand along more than one length of transverse and more particularly to level wind apparatus having a pair of spooling shafts.

2. Description of the Prior Art

Level wind devices for winding flexible strands on a spool by distributing the flexible strand along more than one length of the spooling device are known. Substantially all of the level wind devices include a double threaded spooling shaft. For example, U.S. Pat. Nos. 2,134,369, 1,875,467, 890,213, 1,632,875 and 2,962,906 all disclose a double threaded spool shaft with a follower device that reverses direction at the ends of the double threaded spooling shaft. There is also disclosed in U.S. Pat. No. 1,935,385 an endless chain and sprocket device to move the cable bracket transversely and distribute cable on a spool. The double threaded spooling shaft is expensive to manufacture and requires complex floating follower that reverses direction of traverse at the ends of the spooling shaft. There is a need for a simple level wind device that does not require a double threaded spool shaft and is inexpensive to manufacture and reliable in operation.

SUMMARY OF THE INVENTION

This hereinafter described invention relates to a level wind device for distributing a flexible strand along more than one length of traverse that includes a pair of spooling shafts. The spooling shafts are supported in parallel spaced relation to each other and are connected for rotation in opposite directions. Each of the spooling shafts has a generally cylindrical outer surface with a thread formed therein with a preselected pitch. The thread forms a spiral cam track in the outer surface of the shafts. A strand distributing means includes means positioned in one of the cam tracks of one of the spooling shafts that is operable upon rotation of the spooling shafts to move longitudinally in one of the cam tracks in a first direction to the end of the cam track and thereafter move in the other cam track of the other spooling shaft in the opposite direction to the end of the other cam track.

The cam tracks have inclined end portions to facilitate transfer of the means positioned in one cam track into the other cam track. The spooling shafts are preferably positioned in substantially abutting relation with the cylindrical outer surface of one spooling shaft positioned in overlying relation with the spiral cam track of the other spooling shaft.

In one embodiment the cable guide assembly includes a transversely movable yoke member with a pair of pins. The pins are arranged to be alternately positioned in the cam tacks of the pair of spooling shafts. In another embodiment the flexible strand is positioned in the spiral cam track.

Accordingly, the principal object of this invention is to provide level wind apparatus that does not require a double threaded spooling shaft.

Another object of this invention is to provide a level wind apparatus in which the threads of the spool shafts reverse the direction of the strand guide bracket.

These and other objects of this invention will be more completely disclosed and described in the following specification, the accompanying drawings and the appended claims.

DESCRIPTION OF THE PREFERRED EMBODIMENTS

Figure 1:
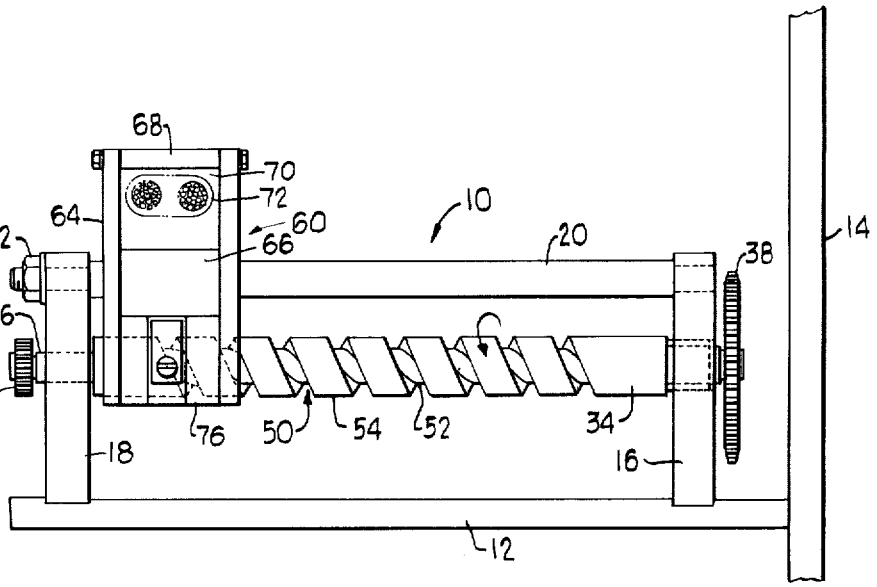
FIG. 1 is a view in front elevation of one embodiment of my improved level wind apparatus.

Referring to the drawings and particularly to FIGS. 1 – 5 there is illustrated an embodiment of my level wind apparatus that is generally designated by the numeral 10. The level wind apparatus 10 is arranged to be associated with a driven spool or reel and is suitably connected thereto by means of chain sprockets and/or gears, as is illustrated in U.S. Pat. Nos. 2,134,369 and 1,875,467, to revolve the spooling shafts at the same ratio as the spool or cable. With this arrangement the shaft rotates through one revolution for each revolution of the spool or reel.

The level wind apparatus includes a base member 12 suitably secured to a frame or support member 14 associated with the reel (not shown). A pair of spaced upstanding brackets 16 and 18 are secured to the base member 12 and are rigidified adjacent there upper portion by a guide bar 20 that is positioned in bracket 16 and secured to bracket 18 by means of nut 22. The brackets 16 and 18 have pairs of aligned apertures 24, 26, 28 and 30 therethrough in which there are rotatably positioned a pair of spooling shafts 32 and 34. The shaft 32 has a first end portion 36 of reduced diameter that extends through aperture 24 in bracket 16 and has a sprocket 38 connected thereto outboard of the bracket 16. The spooling shaft 32 has an opposite end portion 40 of reduced diameter that extends through the aperture 28 in bracket 18 and has a gear 42 connected thereto on the outboard side of bracket 18.

Figure 4:
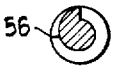
FIG. 4 is a view in section taken along the line IV—IV of FIG. 2 illustrating the inclined surface of the end thread.
Figure 5:
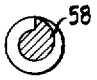
FIG. 5 is a view in section taken along the line V—V of FIG. 2 illustrating the inclined portion of the end thread at the opposite end of the distributor screw shaft.

The other spooling shaft 34 has an end portion 44 of reduced diameter that is journaled in the aperture 26 in bracket 16 and an opposite end portion 46 that extends through aperture 30. A gear 48 is connected to end portion 46 of spooling shaft 34 and is arranged to mesh with the gear 42 connected to the end of the other spooling shaft 32. With this arrangement rotation of spooling shaft 32 by means of drive through sprocket 38 rotates spooling shaft 32 in one direction; as, for example, in a clockwise direction, at a preselected speed and through gears 42 and 48 rotates the other spooling shaft 34 in the opposite direction at the same peripheral speed as spooling shaft 32. The spooling shafts 32 and 34 preferably have the same major diameter and are positioned in closely adjacent relation to each other. Both of the spooling shafts 32 and 34 have a thread formed therein of the same pitch. The thread is preferably a square thread with the thread forming cam tracks 50 in the respective shafts. The thread or cam tracks 50 in both of the spooling shafts 32 and 34 are conventional right-hand square threads that may be easily formed on bar stock in a conventional threading machine. The cam tracks 50 in both spooling shafts 32 and 34 have the same minor diameter and major diameter. For convenience, the thread root 52 and thread sidewalls will be referred to as cam tracks and the thread crest 54 will be referred to as the outer planar peripheral surface of the spooling shafts 32 and 34. The spooling shafts 32 and 34 are so dimensioned that the outer peripheral surface or crest between the threads of spooling shaft 32 is positioned in overlying relation with the thread root 52 or cam track 50. The cam track 50 terminates adjacent the end portion of the shaft in inclined root portions 56 and 58 that mesh into the outer peripheral surface 54 of the respective shafts. The cam tracks 50 on the other shaft also terminate in the inclined portions 56 and 58. Although the inclined portions 56 and 58 are illustrated in FIGS. 4 and 5 as integral with the spooling shaft 34, it should be understood that spiral inserts having the configuration of the inclined portions 56 and 58 could be secured to the thread root 52 of the respective shaft to permit the threads or cam tracks 50 to be rapidly formed on the spooling shafts without forming the inclined portions 56 and 58.

Figure 3:
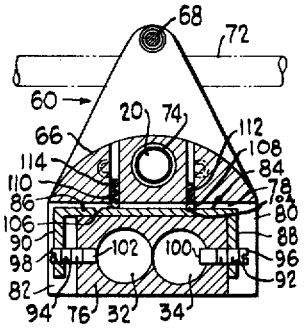
FIG. 3 is a fragmentary view in side elevation and in section illustrating the pin members that are positioned in the cam tracks or threads of the adjacent shafts.

A cable guide assembly generally designated by the numeral 60 has a pair of sidewalls 62 and 64 with an arcuate support portion 66 therebetween. The upper portions of the sidewalls 62 and 64 are connected to each other by a transverse bolt 68 and provide an opening 70 between the sidewalls 62 and 64 above the support portion 66. As is illustrated in FIG. 3, a strand of cable 72 is positioned in the opening 70 and is moved transversely with the cable guide assembly 60. The cable guide assembly body portion 60 has a longitudinal bore 74 therethough and is axially positioned on the shaft 20 for sliding transverse movement across the level wind apparatus. The side walls 62 and 64 have a pair of aligned apertures therethrough to facilitate positioning the cable guide assembly 60 on the pair of spooling shafts 32 and 34. The cable guide assembly 60 has a spooling shaft rider portion 76 that is secured to the sidewalls 62 and 64 and has a pair of longitudinal bores therethrough aligned with the apertures in the respective sidewalls 62 and 64. The cable guide assembly 60 has the spooling shafts 32 and 34 extending through the respective bores in the shaft rider block 76 to permit transverse movement of the cable guide assembly on the respective spooling shafts 32 and 34. The spooling shaft rider block 76 has a longitudinal slot 78 extending therethrough (FIG. 3) and a pair of vertical recessed portions 80 and 82. A U-shaped drive yoke generally designated by the numeral 84 has a horizontal body portion 86 and a pair of depending end portions 88 and 90. The depending end portions 88 and 90 have threaded apertures 92 and 94 therein. Threaded pins 96 and 98 are positioned in the respective apertures 92 and 94 and have end portions 100 and 102 that are arranged to alternately be positioned in the respective cam tracks 50 of the spooling shafts 32 and 34. The body portion 86 of drive yoke 84 is arranged to slide in slot 78 of the spooling rider block 76 to permit movement of the respective pin end portions into and out of the cam tracks 50 of spooling shafts 32 and 34. There are a pair of detents 104 and 106 in the upper surface of the drive yoke body portion 86 to receive ball members 108 and 110 that are urged downwardly within the bracket body portion 66 by means of springs 112 and 114. With this arrangement, the ball member 108 is urged downwardly into detent 104 when the pin end portion 100 extends into the cam track 50 of spooling shaft 34 and the ball member 110 is arranged to be positioned in detent 106 when the pin end portion 102 is in the cam track 50 of spooling shaft 32.

Figure 2:
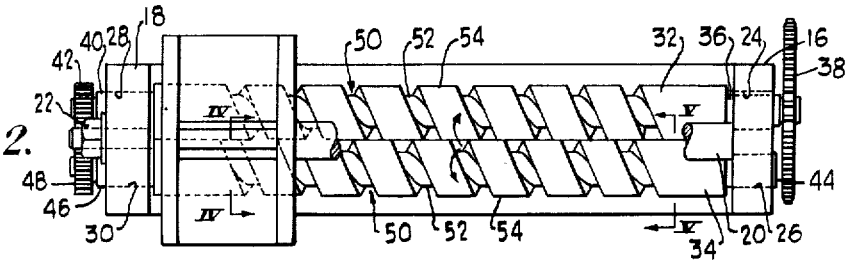
FIG. 2 is a top plan view of the level wind apparatus illustrated in FIG. 1 with the strand guide bracket support shaft partially omitted to illustrate the pair of adjacent spooling shafts.

The foregoing described level wind apparatus 10 operates in the following manner. Rotation is provided for the spooling shafts 32 and 34 through the sprocket 38. The spooling shafts 32 and 34 rotate in opposite directions at the same peripheral speed because of the meshing gears 42 and 48 drivingly connecting the respective shafts. When the cable guide assembly 60 is positioned as illustrated in FIGS. 1 and 2 the pin end portion 100 extends into the cam track 50 of spooling shaft 34 as is illustrated in FIG. 3. Rotation of the spooling shafts 32 and 34 by means of sprocket 38 moves the cable guide assembly 60 transversely from the position illustrated in FIG. 1 along the spooling shafts toward the sprocket 38. The pin end portion 100 in cam track 50 of spooling shaft 34 follows the thread of the spooling shaft 34 and through its connection to the cable guide assembly 60 moves the cable guide assembly therewith to guide the strand or cable 72 transversely across the level wind as the cable is wound onto the spool or reel (not shown). As the cable guide assembly 60 approaches the opposite end of the spooling shaft 34 the pin end portion 100 moves along the inclined surface 58 of thread root 52 and is urged out of the cam track 50 by the inclined surface 58. Simultaneously, the pin end portion 102 rides down a similar inclined portion 58 of spooling shaft 32 that is rotating in the opposite direction and moves into the cam track 50 of spooling shaft 32. Continued rotation of the spooling shafts 32 and 34 causes the cable guide assembly 60 to move transversely toward the opposite ends of the spooling shafts 32 and 34 on which the gears 42 and 48 are connected. While moving transversely the cable guide assembly 60 distributes the strand or cable along the reel as a single layer until the cable guide assembly reaches the opposite ends of the spooling shaft threaded portions. At the end of the threaded portions of shafts 32 and 34 the pin end portion 102 rides up an inclined surface 56 and moves out of the cam track 50 of spooling shaft 32 while the pin end portion 100 moves down a similar inclined portion 56 into the cam track 50 to again move the cable guide assembly 60 transversely across the level wind mechanism. It should be understood that the spooling shafts 32 and 34 have their end portions suitably journaled in bearings within the vertical brackets 16 and 18 and suitable journals may also be provided for the cable guide assembly 60 longitudinal bore 74 and the bores in the rider block 76.

Figure 7:
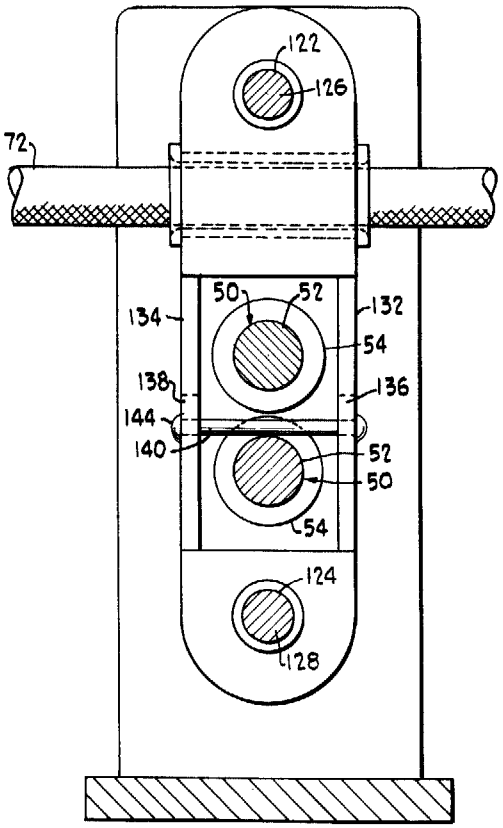
FIG. 7 is a view in side elevation and in section of the embodiment illustrated in FIG. 6 and is taken along the line VII—VII of FIG. 6.
Figure 6:
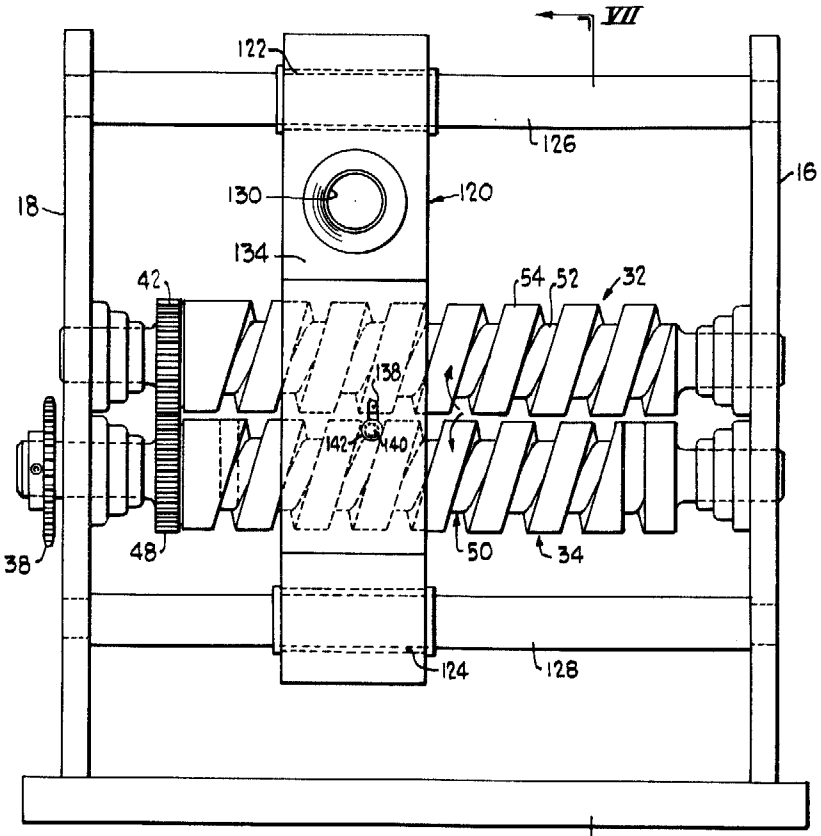
FIG. 6 is a view in front elevation of another embodiment of my improved level wind device in which a vertically movable pin is arranged to be positioned in the threaded or cam track portions of both of the spooling shafts.
Figure 8:
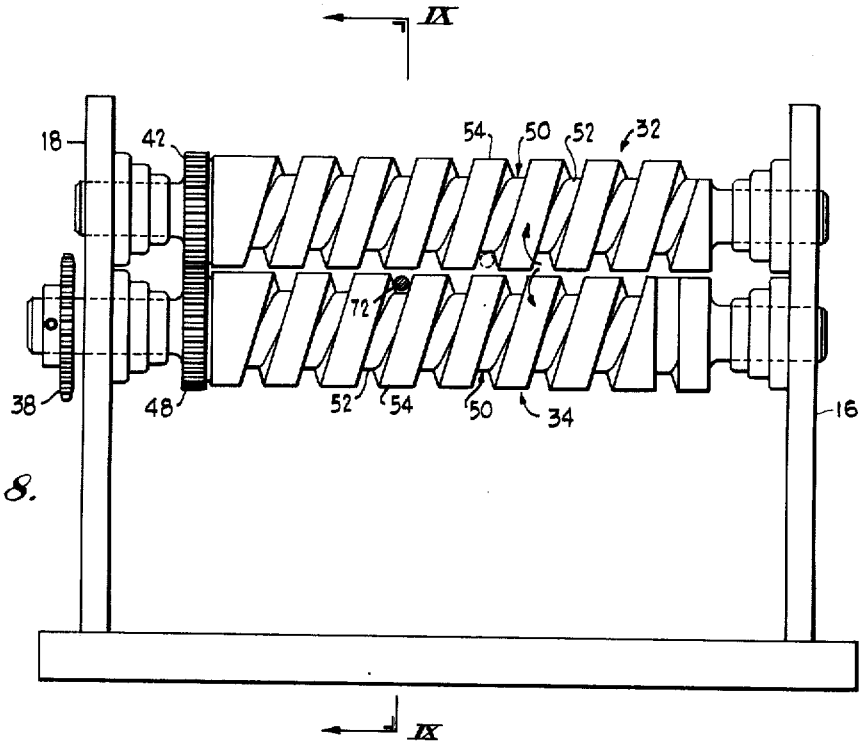
FIG. 8 is a view in front elevation of another embodiment of my invention in which the flexible strand or cable is arranged to ride in the thread or cam tracks of the respective spooling shafts to distribute the flexible strand over more than one length of traverse.

The embodiments illustrated in FIGS. 6 – 8 have a substantial number of similar parts which will be referred to by similar numbers to the same parts illustrated and described in the embodiments of FIGS. 1 – 5.

The embodiments illustrated in FIGS. 6 and 7 include the spooling shafts 32 and 34 journaled in side brackets 16 and 18 in vertical relation to each other. The drive gears 42 and 48 are positioned in both of the side members 18 and the sprocket 38 is connected to the end portion of spooling shaft 34 outboard of the vertical bracket 18. The spooling shafts 32 and 34 are positioned in parallel relation to each other similar to that previously described with the thread crest portion 54 in overlying relation with the cam track 50 of the other spooling shaft. The cable guide assembly generally designated by the numeral 120 has a pair of transverse bores 122 and 124 therethrough. A pair of rods 126 and 128 are secured to the brackets 16 and 18 on opposite sides of the spooling shafts 32 and 34. The cable guide assembly 120 has the rods 126 and 128 extend through the respective bores 122 and 124 so that the cable guide assembly 120 is slidably positioned on the respective rods 126 and 128 for controlled transverse movement. The cable guide assembly 120 has a longitudinal bore 130 through which the strand or cable 72 extends. The bore 130 is sized to permit the cable 72 to slide therethrough.

The cable guide assembly 120 has a pair of vertical front and rear walls 132 and 134 illustrated in FIGS. 6 and 7. The walls 132 and 134 are arranged in spaced relation to each other and have elongated vertical slots 136 and 138 therein. An actuator pin 140 extends between the sidewalls 132 and 134 in the respective slots 136 and 138 and is arranged to move or slide vertically in the respective slots. The pin 140 has head portions 142 and 144 that maintain the pin within the slots 136 and 138 and permit vertical movement therein. The pin 140 is arranged to extend downwardly into the cam track 50 of the respective spooling shafts 32 and 34 as is illustrated in the figures. The spooling shafts 32 and 34 have the opposed inclined surfaces 56 and 58 on the respective end portions of the cam tracks 50 to move the pin upwardly out of one cam track and into the cam track of the other spooling shaft.

The embodiment illustrated in FIGS. 6 and 7 of the level wind apparatus operates in the following manner. With the pin 140 in the cam track 50 of spooling shaft 34 rotation of the spooling shafts 32 and 34 transfers the cable guide assembly 120 by the pin 140 following the cam track 50 in spooling shaft 34. When the pin 140 reaches the end of the cam track 50 on spooling shaft 34 it climbs the inclined surface 58 and the inclined surface 58 on spooling shaft 32 permits the pin 140 to move into the cam track 50 of spooling shaft 32 so that upon further rotation of the spooling shafts 32 and 34 the pin 140 follows the spiral cam track 50 to move the cable guide bracket 120 in an opposite direction toward the gears 42 and 48. At the end of the cam track 50 on spooling shaft 34 the pin 140 follows the inclined surface 56 and returns to the cam track 50 on spooling shaft 34.

Figure 9:
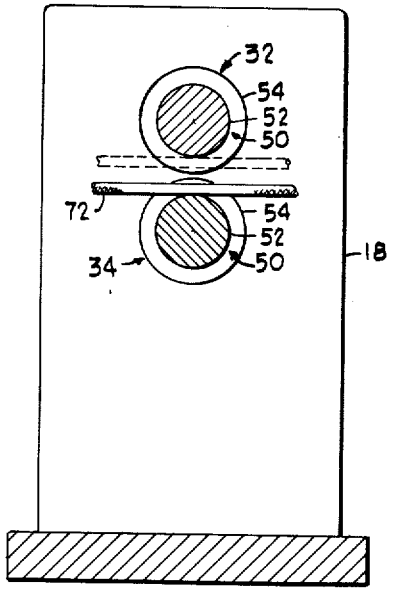
FIG. 9 is a view in side elevation and section taken along the line IX—IX of FIG. 8 illustrating the flexible strand riding in the cam tracks of the respective spooling shafts.

Referring to the embodiment illustrated in FIGS. 8 and 9, it is possible with the pair of spooling shafts 32 and 34 to omit entirely a cable bracket and to utilize the cam tracks 50 as the traverse means for the cable. The strand or cable 72 is threaded through a cam track in one of the spooling shafts 32 or 34 as illustrated in FIGS. 8 and 9. Rotation of the spooling shafts traverses the cable by having the cable follow the spiral cam track 50 in the spooling shaft 34. Thereafter, when the cable has traversed to the end of the spiral cam track 50 of spooling shaft 34 the inclined surface 58 transfers the cable to the spiral cam track 50 of spooling shaft 34. Since the spooling shafts 32 and 34 are rotating in the opposite directions the cable follows the spiral cam track 50 in spooling shaft 32 to traverse the level wind apparatus in the opposite direction.

According to the provisions of the Patent Statutes, the principal, preferred construction and mode of operation of the invention have been explained and described as have what is now considered to represent its best embodiments. It should be expressly understood, however, that the invention is not necessarily limited to the particular embodiments disclosed therein, but may be variously practiced within the scope of the following claims.

I claim:

1. A level wind device for distributing a flexible strand along more than one length of traverse comprising, a pair of spooling shafts, said spooling shafts positioned in substantially abutting relation, means to support said shafts in parallel relation to each other, means to rotate said spooling shafts in opposite directions, each of said spooling shafts having a cylindrical outer surface with a thread formed therein having a preselected pitch, each said thread forming a spiral cam track in a respective shaft cylindrical outer surface, strand distributing means including a yoke member positioned over both of said spooling shafts with depending end portions for transverse movement relative to said spooling shafts, said yoke member depending end portions having pin members extending inwardly toward said spooling shafts and arranged to be alternately positioned in a respective one of said cam tracks so that upon rotation of said spooling shafts said strand distributing means with one of its pin members engaging a respective one of said cam tracks moves longitudinally of one of said spooling shafts in a first direction to the end of said respective cam track and thereafter said yoke member moves transversely to said spooling shafts and positions said other pin member in the other of said cam tracks of the other of said spooling shafts and moves said strand distributing means longitudinally in the opposite direction to the end of said other cam track, a rider block having a pair of longitudinal bores therethrough and a pair of transverse bores opening into said longitudinal bores, said spooling shafts extending through said longitudinal bores, said pin members slidably positioned in said transverse bores, and cam track means for moving said pin member positioned in one of said cam tracks out of said one cam track and said other pin member into the cam track of the other said spooling shafts.

2. A level wind device for distributing a flexible strand along more than one length of traverse as set forth in claim 1 in which said yoke member includes, a body portion slidably positioned on the upper surface of said rider block.

* * * * *